US010034532B2

(12) United States Patent
Zhan

(10) Patent No.: US 10,034,532 B2
(45) Date of Patent: Jul. 31, 2018

(54) COSMETIC CASE

(71) Applicant: COPOLYMER & COSMETICS TECHNOLOGY (KUNSHAN) CO., LTD., Kunshan (CN)

(72) Inventor: Linglang Zhan, Taizhong (TW)

(73) Assignee: COPOLYMER & COSMETICS TECHNOLOGY (KUNSHAN) CO., LTD., Kunshan (CN)

( * ) Notice: Subject to any disclaimer, the term of this patent is extended or adjusted under 35 U.S.C. 154(b) by 0 days.

(21) Appl. No.: 15/712,171

(22) Filed: Sep. 22, 2017

(65) Prior Publication Data

US 2018/0027946 A1 Feb. 1, 2018

Related U.S. Application Data

(63) Continuation-in-part of application No. PCT/CN2015/090480, filed on Sep. 24, 2015.

(30) Foreign Application Priority Data

Mar. 24, 2015 (CN) ..... 2015 1 0130066

(51) Int. Cl.
*B65D 69/00* (2006.01)
*A45D 40/22* (2006.01)
(Continued)

(52) U.S. Cl.
CPC ..... *A45D 40/222* (2013.01); *A45D 40/221* (2013.01); *B65D 43/16* (2013.01);
(Continued)

(58) Field of Classification Search
CPC .. A45D 33/003; A45D 33/006; A45D 33/008; A45D 33/24; A45D 33/34; A45D 13/1084; A45D 40/221; A45D 40/222; B65D 43/16; B65D 43/22; B65D 43/26; B65D 51/24
(Continued)

(56) References Cited

U.S. PATENT DOCUMENTS 4,569,438 A * 2/1986 Sheffler ..... A45D 40/22 206/235
5,909,738 A * 6/1999 Quennessen ..... A45C 13/008 132/293
(Continued)

*Primary Examiner* — Luan K Bui
(74) *Attorney, Agent, or Firm* — Matthias Scholl P.C.; Matthias Scholl

(57) ABSTRACT

A cosmetic case including an outer case assembly and an inner disk assembly. The outer case assembly includes a case body and a case cover. the case body includes a first accommodation chamber having an opening. The inner disk assembly includes a disk body, a disk cover, an outer slot, and a seal ring. The disk body includes a second accommodation chamber for accommodating cosmetics. The case cover is hinged to the case body and adapted to open and close the opening of the first accommodation chamber. The inner disk assembly is disposed detachably in the first accommodation chamber. The disk cover is hinged to the disc body and adapted to open and close the opening of the second accommodation chamber. The outer slot is positioned around the outer side wall of the second accommodation chamber and the seal ring is housed in the outer slot.

6 Claims, 2 Drawing Sheets

(51) Int. Cl.

| | |
|---|---|
| ***B65D 43/22*** | (2006.01) |
| ***B65D 51/24*** | (2006.01) |
| ***B65D 43/26*** | (2006.01) |
| ***B65D 43/16*** | (2006.01) |

(52) U.S. Cl.
CPC ..... *B65D 43/22* (2013.01); *B65D 43/26* (2013.01); *B65D 51/24* (2013.01)

(58) Field of Classification Search
USPC ..... 206/235, 581, 823, 38, 229; 132/293, 132/295, 316
See application file for complete search history.

(56) References Cited

U.S. PATENT DOCUMENTS

| | | | | |
|---|---|---|---|---|
| 6,138,686 | A * | 10/2000 | Yuhara | A45C 13/008 132/293 |
| 6,240,930 | B1 * | 6/2001 | Yuhara | A45C 13/008 132/293 |
| 2006/0118454 | A1 * | 6/2006 | Kang, III | A45D 33/006 206/581 |
| 2006/0151355 | A1 * | 7/2006 | Oh | A45D 33/008 206/581 |
| 2007/0029226 | A1 * | 2/2007 | Yuhara | A45D 33/006 206/581 |
| 2015/0320174 | A1 * | 11/2015 | Kim | A45D 33/006 132/295 |

* cited by examiner

COSMETIC CASE

CROSS-REFERENCE TO RELATED APPLICATIONS

This application is a continuation-in-part of International Patent Application No. PCT/CN2015/090480 with an international filing date of Sep. 24, 2015, designating the United States, now pending, and further claims foreign priority to Chinese Patent Application No. 201510130066.7 filed Mar. 24, 2015. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, and Cambridge, Mass. 02142.

BACKGROUND OF THE INVENTION

Field of the Invention

The present disclosure relates to a cosmetic case that is airtight.

Description of the Related Art

Cosmetics can be accommodated in portable cosmetic cases. However, conventional portable cosmetic cases do not provide adequate sealing, the volatile components in the cosmetics tend to evaporate, hardening and degrading the cosmetics.

SUMMARY OF THE INVENTION

In view of the above-described problems, it is one objective of the invention to provide a cosmetic case that exhibits excellent airtightness.

To achieve the above objective, in accordance with one embodiment of the invention, there is provided a cosmetic case which comprises an outer case assembly comprising a case body and a case cover. The case body comprises a first accommodation chamber. The first accommodation chamber opens into an upper surface of the case body with reference to the usage direction. The case cover is hinged to the case body and adapted to open and close the opening of the first accommodation chamber. An inner disk assembly comprising a disk body and a disk cover is further disposed detachably in the first accommodation chamber. The disk body comprises a second accommodation chamber for accommodating cosmetics. The second accommodation chamber opens into an upper surface of the disc body. The disk cover is hinged to the disc body and adapted to open and close the opening of the second accommodation chamber. An outer slot is further positioned around an outer side wall of the second accommodation chamber and a seal ring is housed in the outer slot. The seal ring is detachably in interference connection to an opening side of the second accommodation chamber.

In a class of this embodiment, one side of the case cover is hinged to a side of the case body via a first hinge, and the other side of the case cover is provided with a first hook member. A button is movably disposed on the other side of the case body. The button comprises a second hook member corresponding to the first hook member and is capable of driving the second hook member to hook to and separate from the first hook member; and the second hook member is integrated with the button.

In a class of this embodiment, an L-shaped rear buckle rib is positioned in the vicinity of the one side of the case cover. The rear buckle rib is resilient and abuts resiliently against an outer side wall of the case body.

In a class of this embodiment, one side of the disc cover is hinged to a side of the disc body via a second hinge. The first hinge is disposed opposite to the button with the second hinge positioned between the first hinge and the button.

In a class of this embodiment, the case body comprises a hollow cylindrical base comprising open upper and lower sides and a flange extending inward radially that is formed on a lower side edge of the base. The base and the flange enclose the first accommodation chamber.

In a class of this embodiment, the disk body is a hollow cylindrical structure with an open upper side. The cavity in the disk body serves as a second accommodation chamber. The outer slot opens upwardly, surrounds a periphery of the disk body, and is integrated with the disk body. The outer side wall of the outer slot comprises a recess that is recessed in the outer side wall of the outer slot.

In a class of this embodiment, the inner disk assembly is disposed detachably in the first accommodation chamber with a structure in which the disc body is coaxially housed in the case body and a lower side of the disk body is freely inserted into a lower opening of the case body. The bottom of the outer slot freely abuts against the flange. A tubular connecting member is further positioned in the first accommodation chamber. The tubular connecting member is fitted over the outer side of the outer slot. A rib that extends inward radially is formed on the inner side wall of the connecting member and is capable of being snapped into and separated from the recess on the outer slot.

In a class of this embodiment, the connecting member is positioned in the first accommodation chamber with a structure in which a flange that extends outward radially is formed on the upper side of the connecting member, the flange abutting against an upper side of the base.

In a class of this embodiment, the seal ring comprises an inner ring body and an outer ring body having different hardness. The outer ring body is fitted over an outer side of the inner ring body and is integrated with the inner ring body through injection molding.

In a class of this embodiment, the hardness of the inner ring body is greater than that of the outer ring body, and the inner ring body is detachably in interference connection to the opening side of the second accommodation chamber.

In a class of this embodiment, the inner side face of the disc cover comprises a collar that is integrated with the disc cover and extends toward the second accommodation chamber with reference to a state in which the disk cover encloses the opening of the second accommodation chamber. The collar can be tightly interposed between the outer ring body and the inner side wall of the outer slot.

In a class of this embodiment, a mirror is positioned on the inner side face of the case cover facing the case body, with reference to a state in which the case cover encloses the opening of the first accommodation chamber.

The cosmetic case of the present disclosure has the advantages over prior art that an inner disk assembly comprising a disc body and a disk cover is disposed detachably in the outer case assembly. The disk body comprises a second accommodation chamber for accommodating cosmetics that opens into an upper surface of the disk body. The disk cover is hinged to the disk body and adapted to open and close the opening of the second accommodation chamber. An outer slot is further positioned around the outer side wall of the second accommodation chamber. A seal ring is further housed in the outer slot. The seal ring is detachably in interference connection to the opening side of the second accommodation chamber, thereby allowing the inner side face of the disk cover to be in close contact with the seal ring, so that the inner disk assembly has an excellent airtight sealing effect and the quality of cosmetics within the inner disc assembly can be maintained for a long time.

Figure 1:
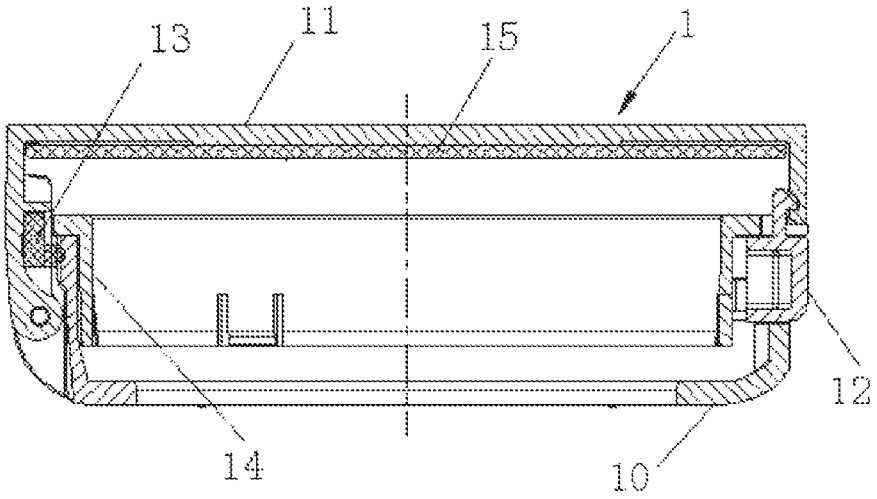
FIG. 1 is a sectional view of an outer case assembly of a cosmetic case in accordance with one embodiment of the present disclosure.
Figure 2:
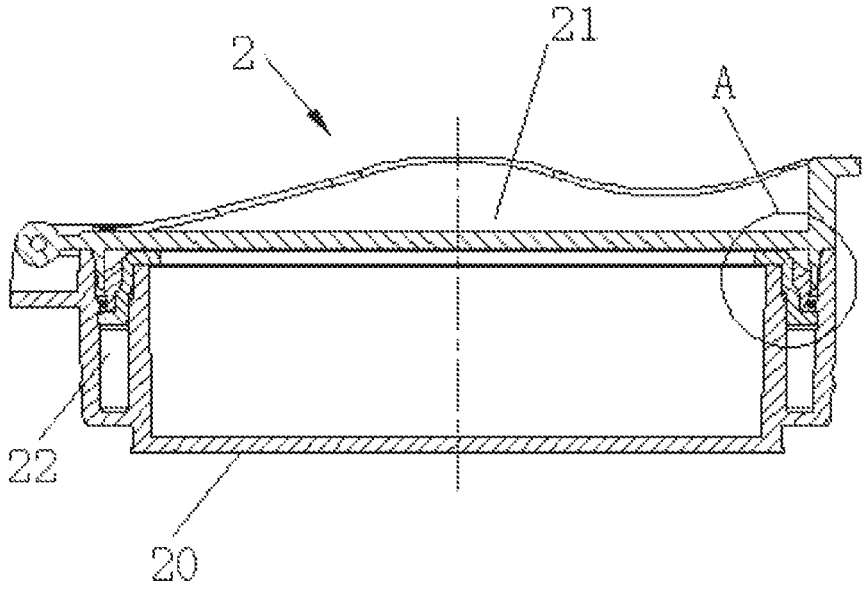
FIG. 2 is a sectional view of an inner disk assembly of a cosmetic case in accordance with one embodiment of the present disclosure.
Figure 3:
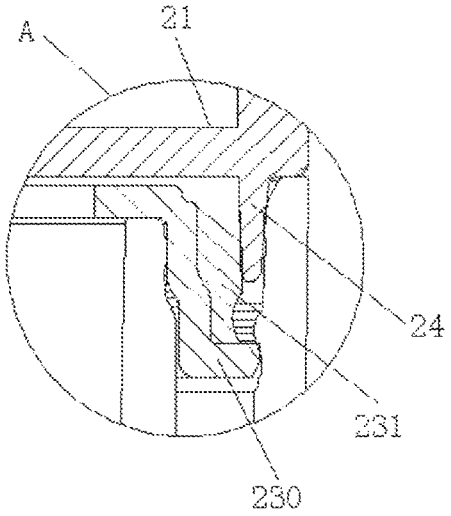
FIG. 3 is an enlarged view of part A in FIG. 2.
Figure 4:
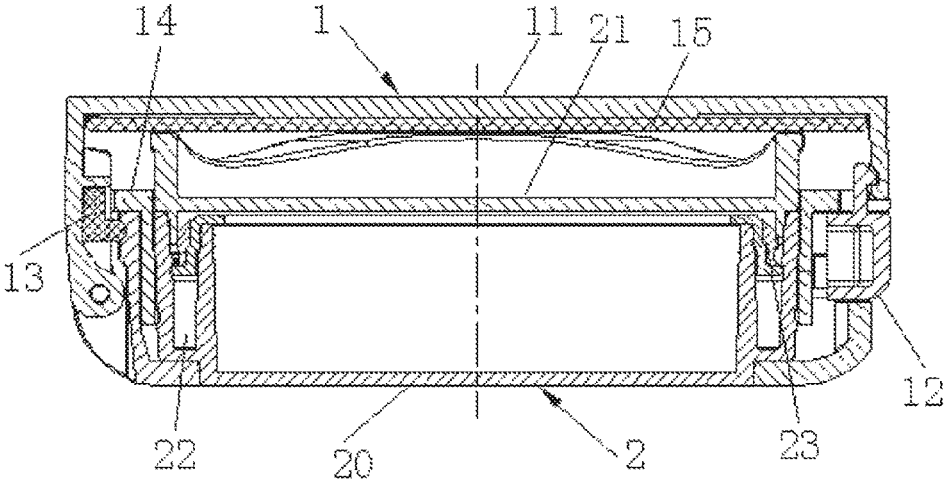
FIG. 4 is a sectional view of a cosmetic case comprising assembled outer case assembly and inner disk assembly in accordance with one embodiment of the present disclosure.

In the drawings, the following reference numbers are used: 1. Outer case assembly; 10. Case body; 11. Case cover; 12. Button; 13. Rear buckle rib; 14. Connecting member; 15. Mirror; 2. Inner disk assembly; 20. Disc body; 21. Disk cover; 22. Outer slot; 23. Seal ring; 230. Inner ring body; 231. Outer ring body; 24. Collar.

DETAILED DESCRIPTION OF THE EMBODIMENTS

For further illustrating the invention, experiments detailing a cosmetic case are described hereinbelow combined with the drawings. It should be noted that the following examples are intended to describe and not to limit the invention.

The cosmetic case having airtightness disclosed in the present disclosure comprises an outer case assembly 1 comprising a case body 10 and a case cover 11. The case body 10 comprises a first accommodation chamber that opens into an upper surface of the case body with reference to the usage direction. The case cover 11 is hinged to the case body 10 and adapted to open and close the opening of the first accommodation chamber. An inner disk assembly 2 comprising a disk body 20 and a disk cover 21 is further disposed detachably in the first accommodation chamber. The disk body 20 comprises a second accommodation chamber for accommodating cosmetics. The second accommodation chamber opens into an upper surface of the disc body. The disk cover 21 is hinged to the disc body 20 and adapted to open and close the opening of the second accommodation chamber. An outer slot 22 is further positioned around an outer side wall of the second accommodation chamber and a seal ring 23 is housed in the outer slot. The seal ring is in interference connection to the opening side of the second accommodation chamber, thereby allowing the inner side face of the disk cover to be in close contact with the seal ring, so that the inner disk assembly has an excellent airtight sealing effect and the quality of cosmetics within the inner disc assembly can be maintained for a long time.

In this embodiment, one side of the case cover 11 is hinged to a side of the case body 10 via a first hinge, and the other side of the case cover 11 is provided with a first hook member. A button 12 is disposed movably on the other side of the case body 10. The button further comprises a second hook member corresponding to the first hook member and is capable of driving the second hook member to hook to and separate from the first hook member; and the second hook member is integrated with the button.

Preferably, an L-shaped rear buckle rib 13 is positioned in the vicinity of the one side of the case cover. The rear buckle rib is resilient and can be driven by the case cover to abut resiliently against the outer side wall of the case body. As such, the case cover can be opened resiliently by the rear buckle rib.

In this embodiment, one side of the disc cover 21 is hinged to a side of the disc body 20 via a second hinge. The first hinge is disposed opposite to the button with the second hinge positioned between the first hinge and the button. Preferably, in this embodiment, a line connecting the center of the first hinge and the center of the case body is perpendicular to a line connecting the center of the second hinge and the center of the disk body.

In this embodiment, the case body 10 comprises a hollow cylindrical base comprising open upper and lower sides and a flange extending inward radially that is formed from a lower side edge of the base. The base and the flange enclose the first accommodation chamber.

The disk body 20 is a hollow cylindrical structure with an open upper side. The cavity in the disk body serves as a second accommodation chamber. The outer slot 22 opens upwardly, surrounds a periphery of the disk body, and is integrated with the disk body. The outer side wall of the outer slot comprises a recess that is recessed in the outer side wall of the outer slot.

The inner disk assembly 2 is disposed detachably in the first accommodation chamber with a structure in which the disc body 20 is coaxially housed in the case body and the lower side of the disk body is freely inserted into the lower opening of the case body 10. The bottom of the outer slot 22 freely abuts against the flange. A tubular connecting member 14 is further positioned in the first accommodation chamber. The tubular connecting member is fitted over the outer side of the outer slot. A rib that extends inward radially is further formed on the inner side wall of the connecting member and is capable of being snapped into and separated from the recess on the outer slot.

Preferably, the connecting member is positioned in the first accommodation chamber with a structure in which a flange that extends outward radially is formed on the upper side of the connecting member, the flange abutting against the upper side of the base.

In this embodiment, the seal ring 23 comprises an inner ring body 230 and an outer ring body 231 that are respectively made of plastic materials having different hardness. The outer ring body is fitted over an outer side of the inner ring body and is integrated with the inner ring body through injection molding.

Preferably, the hardness of the inner ring body is greater than that of the outer ring body, and the inner ring body is detachably in interference connection to the opening side of the second accommodation chamber.

In this embodiment, the inner side face of the disc cover comprises a collar 24 that is integrated with the disc cover and extends toward the second accommodation chamber with reference to a state in which the disk cover 21 encloses the opening of the second accommodation chamber. The collar 24 can be tightly interposed between the outer ring body and the inner side wall of the outer slot so as to further improve the airtight sealing effect of the inner disk assembly.

In this embodiment, a mirror 15 is positioned on the inner side face of the case cover 11 facing the case body, with reference to a state in which the case cover 11 encloses the opening of the first accommodation chamber.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A cosmetic case, comprising:

1) an outer case assembly comprising a case body and a case cover, the case body comprising a first accommodation chamber comprising an opening; and 2) an inner disk assembly comprising a disk body, a disk cover, an outer slot, and a seal ring, the disk body comprising a second accommodation chamber for accommodating cosmetics;

wherein:

the opening of the first accommodation chamber faces an upper surface of the case body with reference to a usage direction of the cosmetic case;

the case cover is hinged to the case body and, when in use, opens and closes the opening of the first accommodation chamber;

the inner disk assembly is disposed detachably in the first accommodation chamber;

an opening of the second accommodation chamber faces an upper surface of the disc body;

the disk cover is hinged to the disc body and, when in use, opens and closes the opening of the second accommodation chamber;

the outer slot is positioned around an outer side wall of the second accommodation chamber and the seal ring is housed in the outer slot;

the seal ring is detachably in interference connection to an opening side of the second accommodation chamber;

one side of the case cover is hinged to a side of the case body via a first hinge, and the other side of the case cover is provided with a first hook member;

a button is movably disposed on the other side of the case body;

the button comprises a second hook member corresponding to the first hook member and is capable of driving the second hook member to hook to and separate from the first hook member;

the second hook member is integrated with the button;

an L-shaped rear buckle rib is positioned in the vicinity of the one side of the case cover; and the rear buckle rib is resilient and abuts resiliently against an outer side wall of the case body.

2. A cosmetic case, comprising:

1) an outer case assembly comprising a case body and a case cover, the case body comprising a first accommodation chamber comprising an opening; and 2) an inner disk assembly comprising a disk body, a disk cover, an outer slot, and a seal ring, the disk body comprising a second accommodation chamber for accommodating cosmetics;

wherein:

the opening of the first accommodation chamber faces an upper surface of the case body with reference to a usage direction of the cosmetic case;

the case cover is hinged to the case body and, when in use, opens and closes the opening of the first accommodation chamber;

the inner disk assembly is disposed detachably in the first accommodation chamber;

an opening of the second accommodation chamber faces an upper surface of the disc body;

the disk cover is hinged to the disc body and, when in use, opens and closes the opening of the second accommodation chamber;

the outer slot is positioned around an outer side wall of the second accommodation chamber and the seal ring is housed in the outer slot;

the seal ring is detachably in interference connection to an opening side of the second accommodation chamber;

the case body comprises a hollow cylindrical base comprising open upper and lower sides and a first flange extending inward radially that is formed on a lower side edge of the base; the base and the first flange enclose the first accommodation chamber;

the disk body is a hollow cylindrical structure with an open upper side; the outer slot opens upwardly, surrounds a periphery of the disk body, and is integrated with the disk body; an outer side wall of the outer slot comprises a recess; and the disc body is coaxially housed in the case body and a lower side of the disk body is freely inserted into a lower opening of the case body; a bottom of the outer slot freely abuts against the first flange; a tubular connecting member is positioned in the first accommodation chamber; the tubular connecting member is fitted over an outer side of the outer slot; a rib that extends inward radially is integrated with an inner side wall of the tubular connecting member and is corresponding to the recess on the outer slot.

3. The case of claim 2, wherein a second flange that extends outward radially is formed on the upper side of the tubular connecting member, and the second flange abuts against an upper side of the base.

4. A cosmetic case, comprising:

1) an outer case assembly comprising a case body and a case cover, the case body comprising a first accommodation chamber comprising an opening; and 2) an inner disk assembly comprising a disk body, a disk cover, an outer slot, and a seal ring, the disk body comprising a second accommodation chamber for accommodating cosmetics;

wherein:

the opening of the first accommodation chamber faces an upper surface of the case body with reference to a usage direction of the cosmetic case;

the case cover is hinged to the case body and, when in use, opens and closes the opening of the first accommodation chamber;

the inner disk assembly is disposed detachably in the first accommodation chamber;

an opening of the second accommodation chamber faces an upper surface of the disc body;

the disk cover is hinged to the disc body and, when in use, opens and closes the opening of the second accommodation chamber;

the outer slot is positioned around an outer side wall of the second accommodation chamber and the seal ring is housed in the outer slot;

the seal ring is detachably in interference connection to an opening side of the second accommodation chamber;

the seal ring comprises an inner ring body and an outer ring body having different hardness; and the outer ring body is fitted over an outer side of the inner ring body and is integrated with the inner ring body through injection molding.

5. The case of claim 4, wherein the hardness of the inner ring body is greater than that of the outer ring body, and the inner ring body is detachably in interference connection to the opening side of the second accommodation chamber.

6. The case of claim 4, wherein the inner side face of the disc cover comprises a collar that is integrated with the disc cover and extends toward the second accommodation chamber; and the collar is tightly interposed between the outer ring body and the inner side wall of the outer slot.

* * * * *